US006215053B1

(12) United States Patent
Adinolfi

(10) Patent No.: US 6,215,053 B1
(45) Date of Patent: Apr. 10, 2001

(54) VARIABLE-THICKNESS SNARE-SIDE DRUMHEAD

(76) Inventor: Alfonso M. Adinolfi, 607-18th Ave. East, Seattle, WA (US) 98112

( * ) Notice: Subject to any disclaimer, the term of this patent is extended or adjusted under 35 U.S.C. 154(b) by 0 days.

(21) Appl. No.: 09/560,843

(22) Filed: Apr. 28, 2000

(51) Int. Cl.[7] ..... G10D 13/02
(52) U.S. Cl. ..... 84/411 R; 84/415; 84/414
(58) Field of Search ..... 84/411 R, 414, 84/415, 416, 411 M

(56) References Cited

U.S. PATENT DOCUMENTS 1,809,050 6/1931 Logan .
3,250,169 5/1966 Stone, Jr. et al. .
4,254,685 3/1981 Rose .
4,616,552 * 10/1986 Jang ..... 84/414
4,798,121 1/1989 Donohoe .
4,809,582 3/1989 Chang .
5,581,044 * 12/1996 Beli et al. ..... 84/414
5,988,716 * 12/1999 Marguez et al. ..... 84/411 P

* cited by examiner

*Primary Examiner*—Shih-Yung Hsieh
(74) *Attorney, Agent, or Firm*—Graybeal Jackson Haley LLP

(57) ABSTRACT

A snare drum snare-side drum head having regions of different vibratory characteristics, as by differing thicknesses, to produce a low-end, or darker, tone in association with the sharp, snap tone of the traditional snare drum.

8 Claims, 4 Drawing Sheets

VARIABLE-THICKNESS SNARE-SIDE DRUMHEAD

TECHNICAL FIELD OF INVENTION

The present invention relates to musical instruments and more particularly to heads for snare drums.

BACKGROUND OF THE INVENTION

The drum is the soul of music, which directs the rhythm of a melody by means of its drumbeat. There are several kinds of drums, but the snare drum in particular provides instrumental color and dynamic power to, and augments the range of, rhythmic and percussive effects.

The snare drum is a musical instrument having two drumheads, an upper-side or batter-side head, and a lower-side or snare-side head. These two drumheads are separated by a shallow cylinder, and acoustically reactive wires, i.e., snare wires, are tensioned across the snare-side head to facilitate a continuous drum roll when one strikes the batter-side head with drumsticks.

In general, the drumheads are formed from a variety of materials or combinations of materials. For example, one can form the heads from animal skin, a combination of skin and fabric, or a polyethylene terephthalate resin marketed under the trade name MYLAR™. In a snare drum, the batter-side head is typically formed of a thick layer of material to withstand the drumstick impacts. The snare-side head is typically formed of a thinner layer of material such that the vibration of the batter-side head causes the snare-side head to vibrate. This vibration results in vibratory interaction of the snare-side head and the snare wires, and this vibratory interaction develops the sharp, snappy sounds that differentiate the traditional snare-drum sounds from the deeper "booming" tone of a bass drum, tympanum, or tom-tom.

Drumheads formed of multiple materials, multiple layers of material and multiple thicknesses of material are disclosed in U.S. Pat. Nos. 1,809,050, 3,250,169, 4,254,685, 4,798,121, and 4,809,582, all of which are incorporated by reference. U.S. Pat. No. 1,809,050 discloses a means of maintaining the necessary taughtness of a skin snare-side drumhead in moist environments by securing a layer of fabric to the layer of skin. The combined thickness of the skin and fabric is thin enough to provide the sharp tone characteristic of the traditional snare drum when subjected to the vibrations of the snare strings. U.S. Pat. No. 3,250,169 discloses a drumhead muffler for muffling the drumhead sound. Specifically, a strip of muffling material is stretched across the drumhead and secured relative to the drumhead by a retaining ring. U.S. Pat. No. 4,254,685 discloses a compound-membrane drumhead for momentarily increasing the pitch of a drum when struck a sharp blow by drumstick while decreasing the decay time of the fundamental tone or mode. U.S. Pat. No. 4,254,685 discloses a flexible, stretch-resistant drumhead membrane having a ring-like section secured to one surface of the drumhead. The ring-like section divides the drumhead into an inner center portion having a first thickness for striking with drumsticks and an outer annular portion of increased thickness extending from the center portion to the outer edge of the drumhead. U.S. Pat. No. 4,798,121 discloses a drumhead that provides a sharp, clear impact sound and an improved resistance to drumstick damage. The drumhead includes an overlay formed of two sheets or lamina of woven synthetic plastic fibers coated with a synthetic plastic material. The two sheets are cross-laminated together and secured to the upper surface of a central region of a plastic-film drumhead. U.S. Pat. No. 4,809,582 discloses a drumhead that generates a changed tonality and timbre of drumbeat. The drumhead includes an inner circular drumhead surface formed of a single layer of material and surrounded by an outer annular surface formed of a double layer of material. The vibrational weave of a drumbeat on the inner circular surface is concentrated by the small inner surface before being absorbed by the outer annular surface.

Great Britain Patent No. GB 2 113 888 A disclosed a multiple-layer drumhead that is formed of two overlapping equal-thickness synthetic layers. An air pocket is formed between the layers and permits vibrations in each layer.

Another drumhead is formed by adhering mirror-finish polyethylene terephthalate rings manufactured by Tonga™, Stamford, Conn., USA to an outer edge of a drumhead surface using a pressure sensitive adhesive to create a different tone and pitch in a drum.

Thus, while drumheads formed of multiple materials, multiple layers of material, and multiple thicknesses are known in the art, such knowledge has not been applied to snare drums. In particular, such knowledge has not been applied to modify the traditional sharp tone provided by the snare drum.

The above described practices and features of the prior art. Excessive thickness in the snare-side head renders the instrument unable to generate sharp tones; especially those produced by vibration of the snare wires. Snare-side drumheads need sufficient thinness to produce the traditional sharp tones characteristic of the snare drum, but tone variation from the traditional sharp tone of the snare drum is a desirable option for many drummers and has application in Field and Marching percussion, "Hip Hop," and "Jungle" music genres for example. Other applications in which a variation from the snare drum's traditional sharp tone are desirable include both studio and "live" performance recording because of overtones that are undesirable in the recording environment. Accordingly, various adhoc means of muting, attenuating and suppressing those undesirable tonal components of the snare drum sound are employed. One desirable, but unavailable, tone variation from the traditional sharp tone of the snare drum is a lower end or "darker" tone, which is not associated with the traditional snare drum. It is difficult to realize the low end or "darker" tone in a snare drum by providing thicker batter-and snare-side drumheads because the ability of the snare wires to vibrationally interact with the snare-side head in response to the impacts on the batter-side head is greatly reduced.

SUMMARY OF THE INVENTION

In one aspect of the invention, a snare drum has a variable thickness snare-side drumhead that allows the snare drum to produce a low end or "darker" tone. For example, a low end or "dark" tone is generated by a snare-side drumhead having a snare contact region proximate that has vibratory response characteristics different from those of the surrounding region. In a preferred embodiment, the contact region is approximately the same thickness as a traditional snare-side head and the surrounding region is thicker like a typical batter-side head. Accordingly, a low-end or "darker" tone is produced due to the different vibratory response characteristics of the thicker surrounding region, but the sharp sound produced by the vibratory interaction of the snare wires and the thinner snare-wire contact region is not undesirably interfered with.

DETAILED DESCRIPTION OF THE PREFERRED EMBODIMENT OF THE INVENTION

Figure 1:
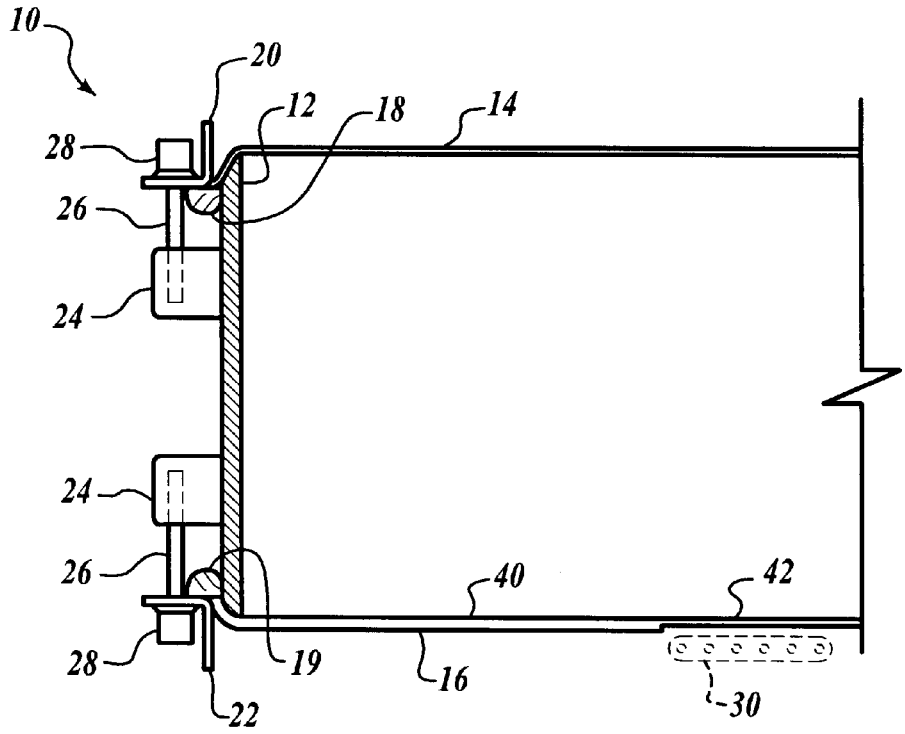
FIG. 1 is a cross-sectional side view of an embodiment of the present snare drum invention.

FIG. 1 is a cross-sectional side view of a conventional snare drum 10 . The snare drum 10 includes a generally cylindrical shell 12. A batter-side head 14 is mounted to one end of the shell 12, and a snare-side head 16 is mounted to the other end of the shell 12. The peripheral edges of the heads 14 and 16 terminate respectively in circular beads 18 and 19, which respectively surround the batter and snare sides of the shell 12. A batter-side hoop 20 rests on the bead 18, and, similarly, a snare-side hoop 22 rests on the bead 19. Pairs of lugs 24 are positioned about the outer surface of shell 12. Tension rods 26 pass through flanges in the hoops 20 and 22 into the lugs 24. One can tighten tension rod nuts 28 in such a manner as to urge the hoops 20 and 22 towards each other, thus pulling the drum heads 14 and 16 more tightly over their respective ends of the shell. Snare wires 30 (shown in cross section) pass across the face of the snare-side head 16.

Figure 2:
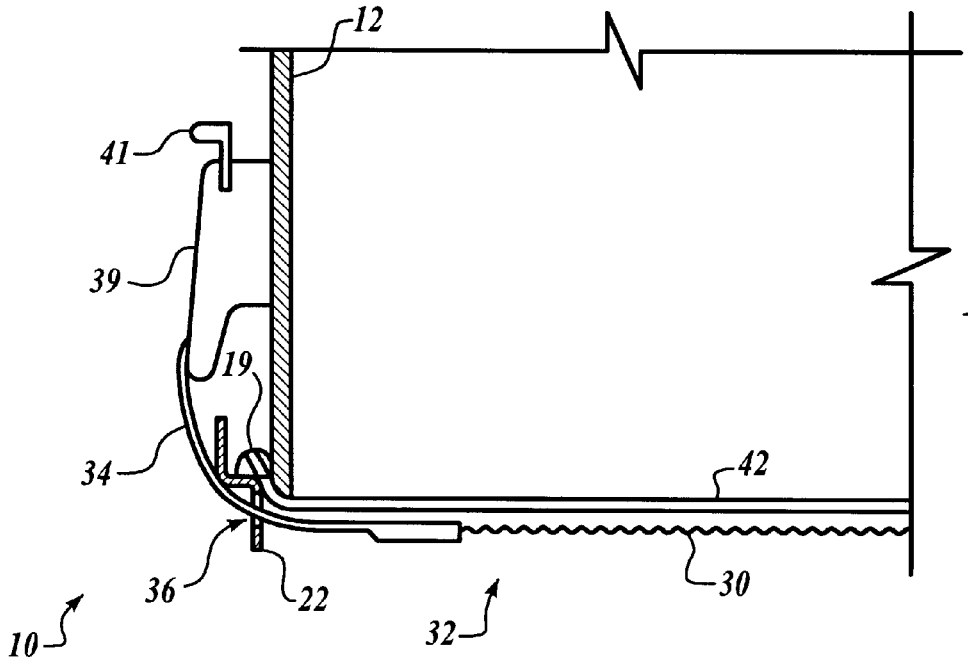
FIG. 2 is a cross-sectional side view of the snare drum of FIG. 1 rotated approximately 90° C.

FIG. 2 is a cross-sectional side view of the snare drum 10 taken from a perspective approximately 90° C. from the view of FIG. 1. The snare wires 30 are assembled together into a snare 32. Passing through each end of the snare 32 are straps 34. One strap 34 passes through a first gate 36 (an opening) in the snareside hoop 22 where it is fastened to a "throwoff" 39. The throwoff 39 includes a lever 41, which a drummer (not shown) manipulates to apply more or less tension to the snare 32. A similar strap (not shown) is attached to the opposite end of the snare 32 where it passes through another gate (not shown) in the snare-side hoop 22 where it is then secured to a fitting known as a "butt end" on the shell 12 (not shown). When the snare 32 is under tension, the snare wires 30 are held in close proximity or contact with the snare-side head 16. When a drummer strikes the batter-side head 14 and it vibrates, thus causing the snare-side head 16 to vibrate against the snare 32. This vibration produces the characteristic sharp or snappy sound of the snare drum 10. If the drummer prefers, he can release the tension on the snare 32 so that it does not contact the snare-side head 16 when the snare-side head 16 vibrates, and this does not produce the snare.

Figure 3:
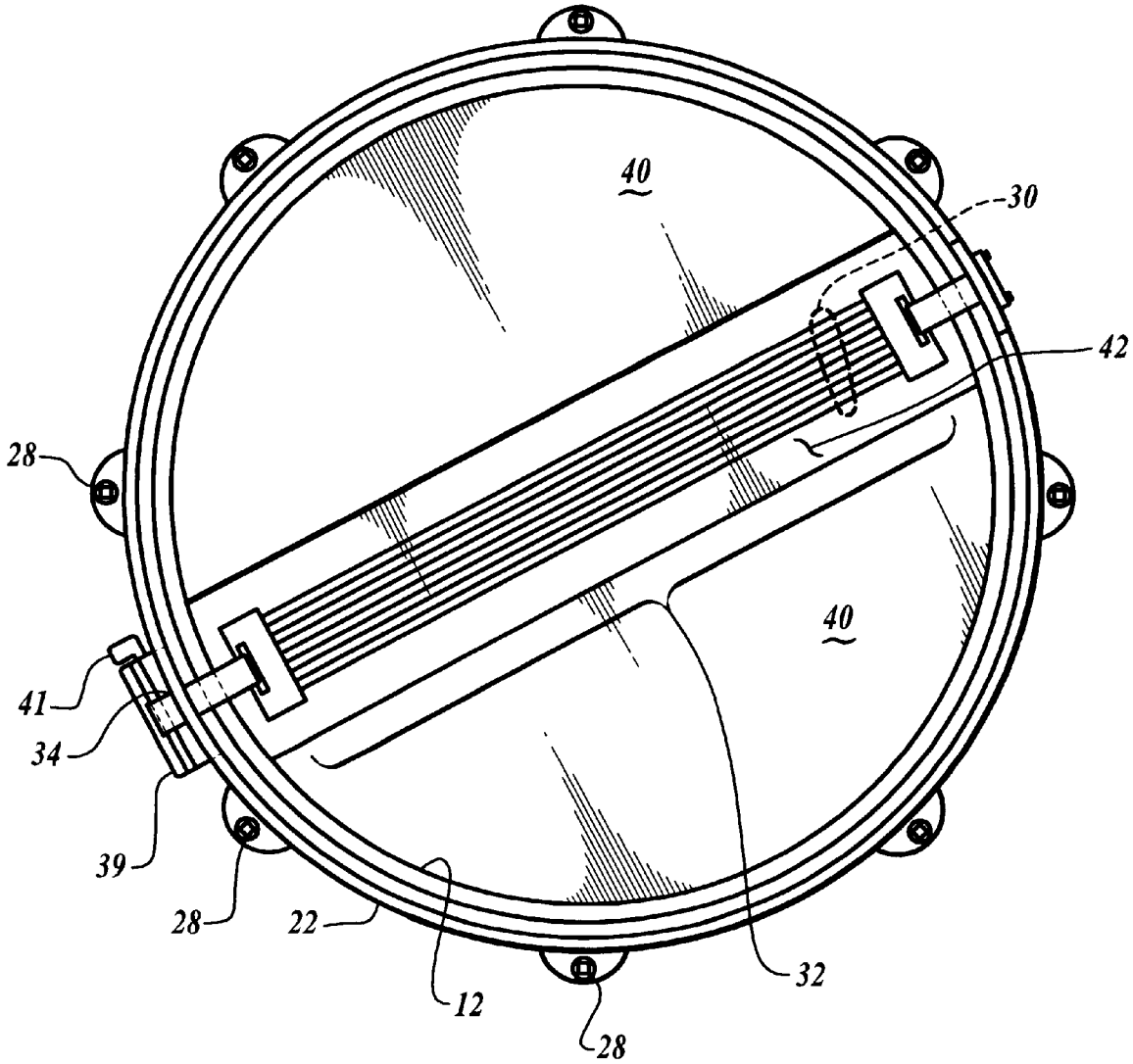
FIG. 3 is a plan view of the snare-side of a snare drum according to an embodiment of the invention.

FIG. 3 is a bottom plan view of a snare drum according to an embodiment of the invention. Where elements discussed above in conjunction with FIG. 1 are identified by like numerals in FIG. 3. A snare-side head 16 has a first region 40, which is two generally half moon regions. A second region, snare contact region, 42 is substantially rectangular is shape, its long axis being generally aligned with the long axis of the snare 32.

The snare contact region 42 has vibratory response characteristics, such as pitch, amplitude (loudness), or damping rate, such that it responds to the vibration of the batter-side head as described above in conjunction with FIG. 1. However, the vibratory response characteristics of the first region 40 are different than those of the snare contact region 42. The vibratory response characteristics of region 40 produce a "low-end" or "darker" tone in conjunction with the "snap" sound typically associated with the reaction of a snare against the snare contact region 42. Such a combination of tones is achieved by constructing the snare-side drumhead with regions of differing acoustic or vibratory response characteristics or properties. Furthermore, the vibratory properties of the first region are chosen to aid in muting or attentuating undesireable overtones as discussed above in the background.

In a preferred embodiment, the snare-side head 16 is constructed of Mylar. The first region 40 has a thickness commonly used in batter-side heads and in the range of approximately 0.007 inches to 0.014 inches, or any subrange within this range. And, the snare contact region 42 has a thickness approximately in the range of 0.002 inches to 0.005 or any subrange within this range, such thicknesses being commonly used in traditional snare-side heads. However, these dimensions may be varied to produce different acoustic effects.

Figure 4A:
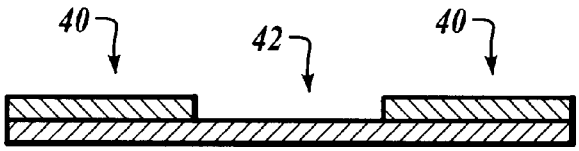
FIG. 4A is a cross-sectioned view of a multi-layer snare-side drumhead according to an embodiment of the invention.

FIG. 4A is a cross-section view of the snare-side head 16 constructed of multiple layers of material bonded together to form the first region 40 which is thicker than the snare contact region 42.

Figure 4B:
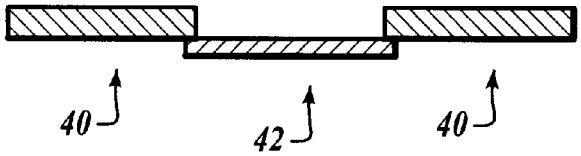
FIG. 4B is a cross-sectional view of multi-layer snare-side drumhead according to another embodiment of the invention.

FIG. 4B is a cross-sectional view of another embodiment of the head 16, which is formed by bonding together materials of different thicknesses to produce the regions 40 and 42 of differing vibratory properties.

Figure 4C:
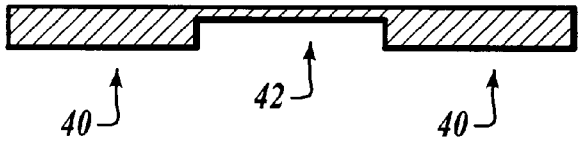
FIG. 4C is a cross-sectional view of a multi-thickness snare-side drumhead according to another embodiment of the invention.

FIG. 4C is a cross-sectional view of yet another embodiment of the snare-side head 16, which is constructed of a single piece of material, but formed or treated in a manner to produce the regions of different vibratory response suitable to the invention. For example, a sheet of typical batter-side head material can be machined to remove a portion of the material to reduce the thickness in the snare contact region 42.

Figure 4D:
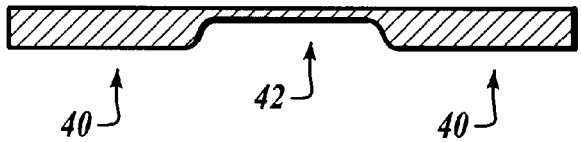
FIG. 4D is a cross-sectional view of another embodiment of the multi-thickness snare-side drumhead of FIG. 4C.

FIG. 4D is a cross-section view of an embodiment of the head of FIG. 4C where instead of removing material, as by a machining process, a unitary sheet of material is processed under heat and pressure in a mold to form areas of differing thicknesses. An additional advantage to this approach is that the sharp edges of the FIG. 4C embodiment can be rounded, thereby reducing stress concentrations or the likelihood of damage due to a foreign object catching on an edge.

Figure 4E:
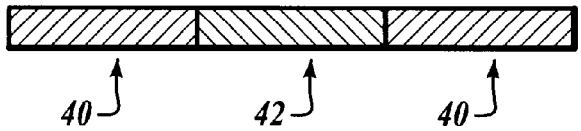
FIG. 4E is a cross-sectional view of a snare-side drumhead having regions of different vibratory characteristics according to an embodiment of the invention.
Figure 4F:
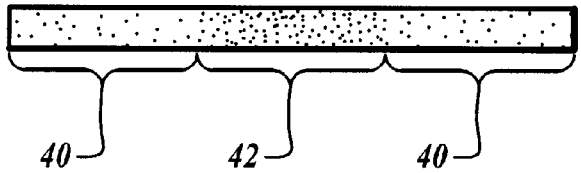
FIG. 4F is a cross-sectional view of another embodiment of the invention.

Referring to FIGS. 4E and 4F, in other embodiments, similar results may be derived from materials of the same or similar thickness, but having different vibratory characteristics, namely, the snare contact region 42 being responsive to frequencies sufficient to produce the desired reaction with the snare 32, and the first region 40 responsive to vibrations sufficient to produce the desire low-end tones.

Combinations of materials with differing densities and flexural characteristics are adaptable to such a snare-side head as depicted in FIG. 4E. FIG. 4E illustrates the snare-side head 16, constructed of two different materials having similar thicknesses. Snare contact region 42 is constructed of a material having a vibratory response similar to the typical snare-side head as described above. The region 40 is formed of a material having vibratory response characteristics similar to a typical batter-side head as discussed above. The two dis-similar materials are then joined at their edges.

Figure 5A:
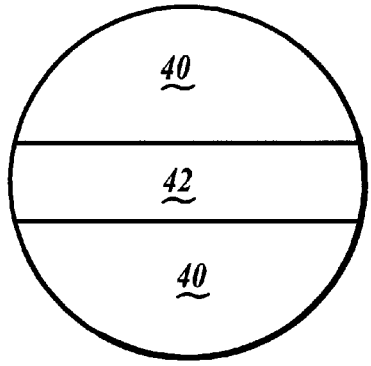
FIG. 5A is a plan view of a snare-side drumhead according to an embodimentof the invention.

Alternatively, referring to FIG. 4F, a single material may be treated, as by heat, chemical or other structure modifying process, to produce the regions 40 and 42 having different vibratory response characteristics. Some polymers for instance tend to become stiffer and denser in areas exposed to certain temperatures. The area of a polymer snare side drumhead so treated would be suitable as the snare contact region 42 while the remaining non-treated regions would be more reproductive of the desired low-end tones. Referring to FIG. 5A, in a preferred embodiment the shape of the snare contact region 42, may be substantially rectangular.

Figure 5B:
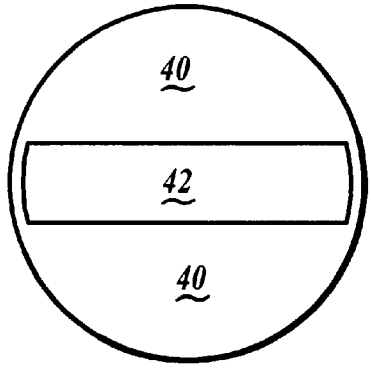
FIG. 5B is a plan view of a snare-side drumhead according to another embodiment of the invention depicts an alternative generally rectangular snare contact portion of the present invention.

Referring to FIG. 5B, a slightly different variation of the region 42 is shown wherein the substantially rectangular region 42 does not extend all the way to the edge of the drumhead. This embodiment may be more suitable to different methods of forming the bead portion 19 around the periphery where it may be preferred that the head material engaged in the bead is of the same thickness.

Figure 5C:
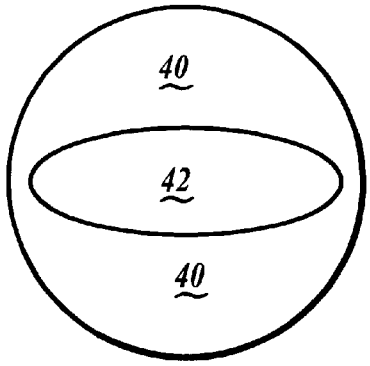
FIG. 5C is a plan view of a snare-side drumhead according to another embodiment of the invention.

FIG. 5C depicts a snare contact region 42, which is still elongate as shown in FIGS. 5A and 5B, but ellipsoidal in shape rather than rectangular. Depending on the size and shape of the snare, and the head manufacturing method employed, such an ellipsoidal shape may be more suitable.

Referring to FIGS. 5A–5C, the snare contact region 42 does not have to be exactly the width of the snare, nor exactly the length of the snare to be effective. Likewise, the snare contact region 42 does not have to be a single continuous region. Instead, multiple separate areas may together form the snare contact region 42 and still produce the desired acoustical effect.

The present invention can be used in the manufacture of new snare drums or in the retrofitting of existing snare drums. In either case, the method of installation or assembly of the drum with respect to the snare-side head 16 is similar. The snareside head 16 is mounted onto the snare-side end of a drum so that, when the snare 32 is mounted on the drum, the snare 32 is proximate the snare contact region 42. Generally speaking, this will result in the long axis of the snare contact region 42 being substantially parallel to, or in alignment with, the long axis of the snare 32 and thus in alignment with the snare wires 30.

Figure 6:
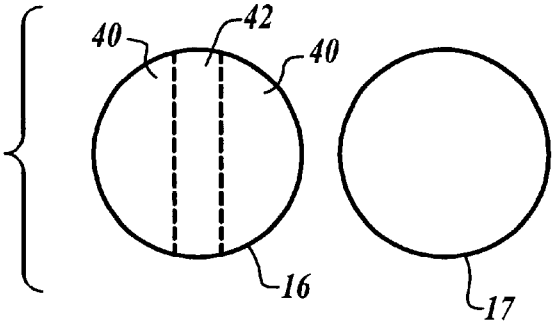
FIG. 6 is a schematic representation of a two piece drum set wherein one drum is equipped with the invention and one drum is not.

FIG. 6 illustrates a simple two piece drum set comprising a snare drum 10 having the snare side head 16 of the present invention thereon, and a non-snare drum 17. The snare contact region 42 and the surrounding first region 40 are shown in phantom line. The drum set incorporating the present invention of course may, and usually will, have more than two drums.

From the foregoing it will be appreciated that, although specific embodiments of the invention have been described herein for purposes of illustration, various modifications may be made without deviating from the spirit and scope of the invention.

What is claimed is:

1. A snare-side drumhead, comprising:

a first region having a first thickness; and a snare contact region having a second thickness that is less than the first thickness and is elongate in shape.

2. The snare-side drumhead of claim 1, wherein the snare contact region is approximately in the range of 0.002 inches to 0.005 inches thick.

3. A snare drum, comprising:

a drum shell having a batter-side end and a snare-side end;

a batter-side head mounted to the batter-side end; and a snare-side head mounted to the snare-side end, the snare-side head having a first region having a first thickness, and a snare contact region having a second thickness that is different from the first thickness.

4. The snare drum of claim 3, wherein the second thickness is less than the first thickness.

5. The snare drum of claim 3, wherein the snare contact region is approximately in the range of 0.002 inches to 0.005 inches thick.

6. A set of drums, comprising:

a non-snare drum; and a snare drum, the snare drum having a snare-side head, the snare-side head having a first region having a first thickness, and a snare contact region having a second thickness that is different from the first thickness.

7. The drum set of claim 6, wherein the second thickness is less than the first thickness.

8. A method of assembling a snare drum, comprising the steps of:

mounting a snare-side head to a snare-side end of a drum shell, the snare-side head having a first contact region having a first thickness, and a snare contact region having a second thickness that is different from the first thickness and being elongate in shape, mounting a snare to the snare-side end of the drum shell; and aligning a long axis of the snare with a long axis of the snare contact region.

* * * * *